US007442034B2

(12) United States Patent
Chenevert et al.

(10) Patent No.: US 7,442,034 B2
(45) Date of Patent: Oct. 28, 2008

(54) DETONATIVE CLEANING APPARATUS

(75) Inventors: Blake C. Chenevert, Redmond, WA (US); Ralph E. McDonald, Maryville, TN (US); Raymond N Henderson, Federal Way, WA (US); Paul M. Brown, Seattle, WA (US)

(73) Assignee: SHOCKSystem, Inc., Glastonbury, CT (US)

( * ) Notice: Subject to any disclaimer, the term of this patent is extended or adjusted under 35 U.S.C. 154(b) by 733 days.

(21) Appl. No.: 10/733,544

(22) Filed: Dec. 11, 2003

(65) Prior Publication Data

US 2005/0125931 A1 Jun. 16, 2005

(51) Int. Cl.
*F23J 7/00* (2006.01)

(52) U.S. Cl. ..... 431/3; 431/1; 431/121

(58) Field of Classification Search ..... 431/121, 431/3, 1; 122/379; 134/30; 15/316.1
See application file for complete search history.

(56) References Cited

U.S. PATENT DOCUMENTS

| | | | | |
|---|---|---|---|---|
| 3,216,046 | A * | 11/1965 | Chappell | 15/317 |
| 4,095,935 | A * | 6/1978 | Menegaz et al. | 431/167 |
| 4,375,710 | A | 3/1983 | Hammond | |
| 5,430,691 | A | 7/1995 | Fridman | |
| 5,494,004 | A * | 2/1996 | Hunter, Jr. | 122/395 |
| 6,431,073 | B1 * | 8/2002 | Zilka et al. | 102/302 |
| 6,438,191 | B1 | 8/2002 | Bickes, Jr. et al. | |
| 6,684,823 | B1 * | 2/2004 | Plavnik et al. | 122/379 |
| 6,935,281 | B2 * | 8/2005 | Ruegg | 122/379 |
| 7,011,047 | B2 * | 3/2006 | Aarnio et al. | 122/379 |
| 7,104,223 | B2 * | 9/2006 | Bussing | 122/379 |
| 2002/0112638 | A1 | 8/2002 | Zilka et al. | |

FOREIGN PATENT DOCUMENTS

| | | |
|---|---|---|
| JP | 06-213763 | 8/1994 |
| JP | 07-260620 | 10/1995 |
| JP | 07-332648 | 12/1995 |
| JP | 2003-320331 | 11/2003 |
| YU | P 1756/88 | 6/1990 |
| YU | P 1728/88 | 2/1992 |

OTHER PUBLICATIONS

Hanjalic et al., "Detonation-Wave Technique for On-Load Deposit . . . ", Journal of Engineering for Gas Turbines and Power, Jan. 1994, pp. 223-236, vol. 116.
Huque, "Experimental Investigation of Slag Removal Using . . . ", Annual Symposium, Mar. 16-18, 1999, pp. 1-6, Miami, FL.
Hanjalic et al., "Further Experience in Using Detonation Waves . . . ", International Journal of Energy Research, Apr. 7, 1993, pp. 583-595, vol. 17.

* cited by examiner

*Primary Examiner*—Steven B. McAllister
*Assistant Examiner*—Chuka C Ndubizu
(74) *Attorney, Agent, or Firm*—McCormick, Paulding & Huber LLP

(57) ABSTRACT

An apparatus for cleaning a surface within a vessel has an elongate combustion conduit extending from an upstream end to a downstream end. The downstream end is associated with an aperture in the wall of the vessel and is positioned to direct a shockwave toward the surface. At least one hanger supports the combustion conduit at at least one location along a length of the combustion conduit.

19 Claims, 7 Drawing Sheets

DETONATIVE CLEANING APPARATUS

BACKGROUND OF THE INVENTION (1) Field of the Invention

The invention relates to industrial equipment. More particularly, the invention relates to the detonative cleaning of industrial equipment.

(2) Description of the Related Art

Surface fouling is a major problem in industrial equipment. Such equipment includes furnaces (coal, oil, waste, etc.), boilers, gasifiers, reactors, heat exchangers, and the like. Typically the equipment involves a vessel containing internal heat transfer surfaces that are subjected to fouling by accumulating particulate such as soot, ash, minerals and other products and byproducts of combustion, more integrated buildup such as slag and/or fouling, and the like. Such particulate build-up may progressively interfere with plant operation, reducing efficiency and throughput and potentially causing damage. Cleaning of the equipment is therefore highly desirable and is attended by a number of relevant considerations. Often direct access to the fouled surfaces is difficult. Additionally, to maintain revenue it is desirable to minimize industrial equipment downtime and related costs associated with cleaning. A variety of technologies have been proposed. By way of example, various technologies have been proposed in U.S. Pat. Nos. 5,494,004 and 6,438,191 and U.S. patent application publication 2002/0112638. Additional technology is disclosed in Huque, Z. Experimental Investigation of Slag Removal Using Pulse Detonation Wave Technique, DOE/HBCU/OMI Annual Symposium, Miami, Fla., Mar. 16-18, 1999. Particular blast wave techniques are described by Hanjalićand Smajevićin their publications: Hanjalić, K. and Smajević, I., Further Experience Using Detonation Waves for Cleaning Boiler Heating Surfaces, International Journal of Energy Research Vol. 17, 583-595 (1993) and Hanjalić, K. and Smajević, I., Detonation-Wave Technique for On-load Deposit Removal from Surfaces Exposed to Fouling: Parts I and II, Journal of Engineering for Gas Turbines and Power, Transactions of the ASME, Vol. 1, 116 223-236, January 1994. Such systems are also discussed in Yugoslav patent publications P 1756/88 and P 1728/88. Such systems are often identified as "soot blowers" after an exemplary application for the technology.

Nevertheless, there remain opportunities for further improvement in the field.

SUMMARY OF THE INVENTION

Accordingly, one aspect of the invention involves an apparatus for cleaning a surface within a vessel. An elongate combustion conduit extends from an upstream end to a downstream end associated with an aperture in the wall of the vessel and positioned to direct a shockwave toward the surface. One or more hangers support the combustion conduit at one or more locations along a length of the combustion conduit.

In various implementations, the combustion conduit may pass above a first external tube bundle and below a second external tube bundle. The combustion conduit may have at least one curved portion. The hangers may be spring hangers. The hangers may engage first portions of the combustion conduit and a second portion of the combustion conduit, downstream of the first, may be held relative to the vessel so as to move vertically with the vessel due to thermal expansion of the vessel. The hangers may compliantly accommodate such vertical movement. A nozzle portion of the combustion conduit may be parallel to but offset from a second portion of the combustion conduit. The second portion may form a majority of a length of the combustion conduit. The combustion conduit may have a number of segments assembled end-to-end. External braces may span a length of at least one of the segments. There may be first and second such external braces opposite each other and coupled to each other by at least one clamp grasping a body of an associated one of the segments. There may be third and fourth such braces respectively aligned end-to-end with the first and second external braces and secured thereto and extending relative thereto at a non-right and non-zero angle. There may be a support structure integral with the wall. At least one of the hangers may support the combustion conduit from the support structure.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
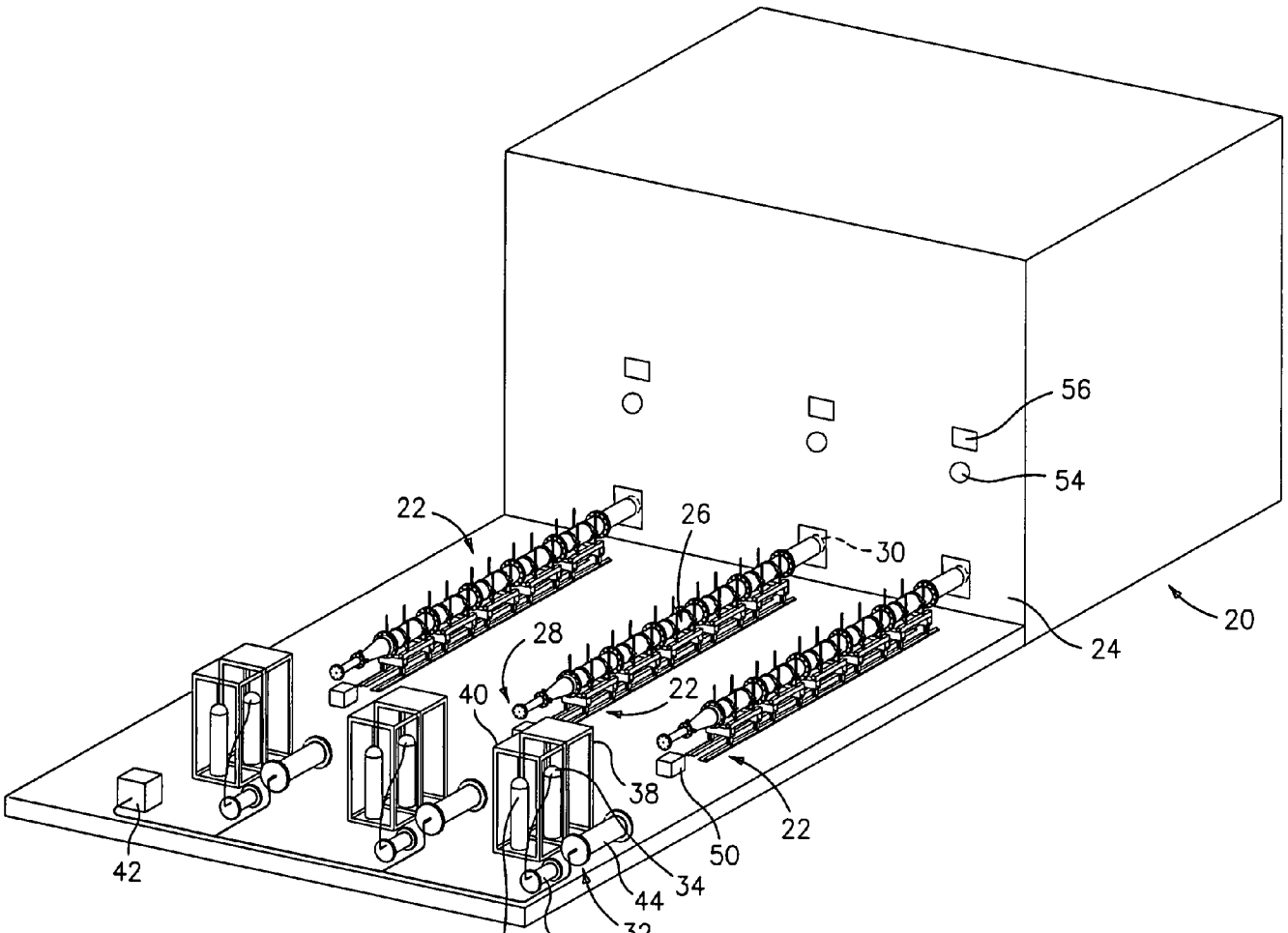
FIG. 1 is a view of an industrial furnace associated with several soot blowers positioned to clean a level of the furnace.

FIG. 1 shows a furnace 20 having an exemplary three associated soot blowers 22. In the illustrated embodiment, the furnace vessel is formed as a right parallelepiped and the soot blowers are all associated with a single common wall 24 of the vessel and are positioned at like height along the wall. Other configurations are possible (e.g., a single soot blower, one or more soot blowers on each of multiple levels, and the like).

Each soot blower 22 includes an elongate combustion conduit 26 extending from an upstream distal end 28 away from the furnace wall 24 to a downstream proximal end 30 closely associated with the wall 24. Optionally, however, the end 30 may be well within the furnace. In operation of each soot blower, combustion of a fuel/oxidizer mixture within the conduit 26 is initiated proximate the upstream end (e.g., within an upstreammost 10% of a conduit length) to produce a detonation wave which is expelled from the downstream end as a shock wave along with associated combustion gases for cleaning surfaces within the interior volume of the furnace. Each soot blower may be associated with a fuel/oxidizer source 32. Such source or one or more components thereof may be shared amongst the various soot blowers. An exemplary source includes a liquified or compressed gaseous fuel cylinder 34 and an oxygen cylinder 36 in respective containment structures 38 and 40. In the exemplary embodiment, the oxidizer is a first oxidizer such as essentially pure oxygen. A second oxidizer may be in the form of shop air delivered from a central air source 42. In the exemplary embodiment, air is stored in an air accumulator 44. Fuel, expanded from that in the cylinder 34 is generally stored in a fuel accumulator 46. Each exemplary source 32 is coupled to the associated conduit 26 by appropriate plumbing below. Similarly, each soot blower includes a spark box 50 for initiating combustion of the fuel oxidizer mixture and which, along with the source 32, is controlled by a control and monitoring system (not shown). FIG. 1 further shows the wall 24 as including a number of ports for inspection and/or measurement. Exemplary ports include an optical monitoring port 54 and a temperature monitoring port 56 associated with each soot blower 22 for respectively receiving an infrared and/or visible light video camera and thermocouple probe for viewing the surfaces to be cleaned and monitoring internal temperatures. Other probes/monitoring/sampling may be utilized, including pressure monitoring, composition sampling, and the like.

Figure 2:
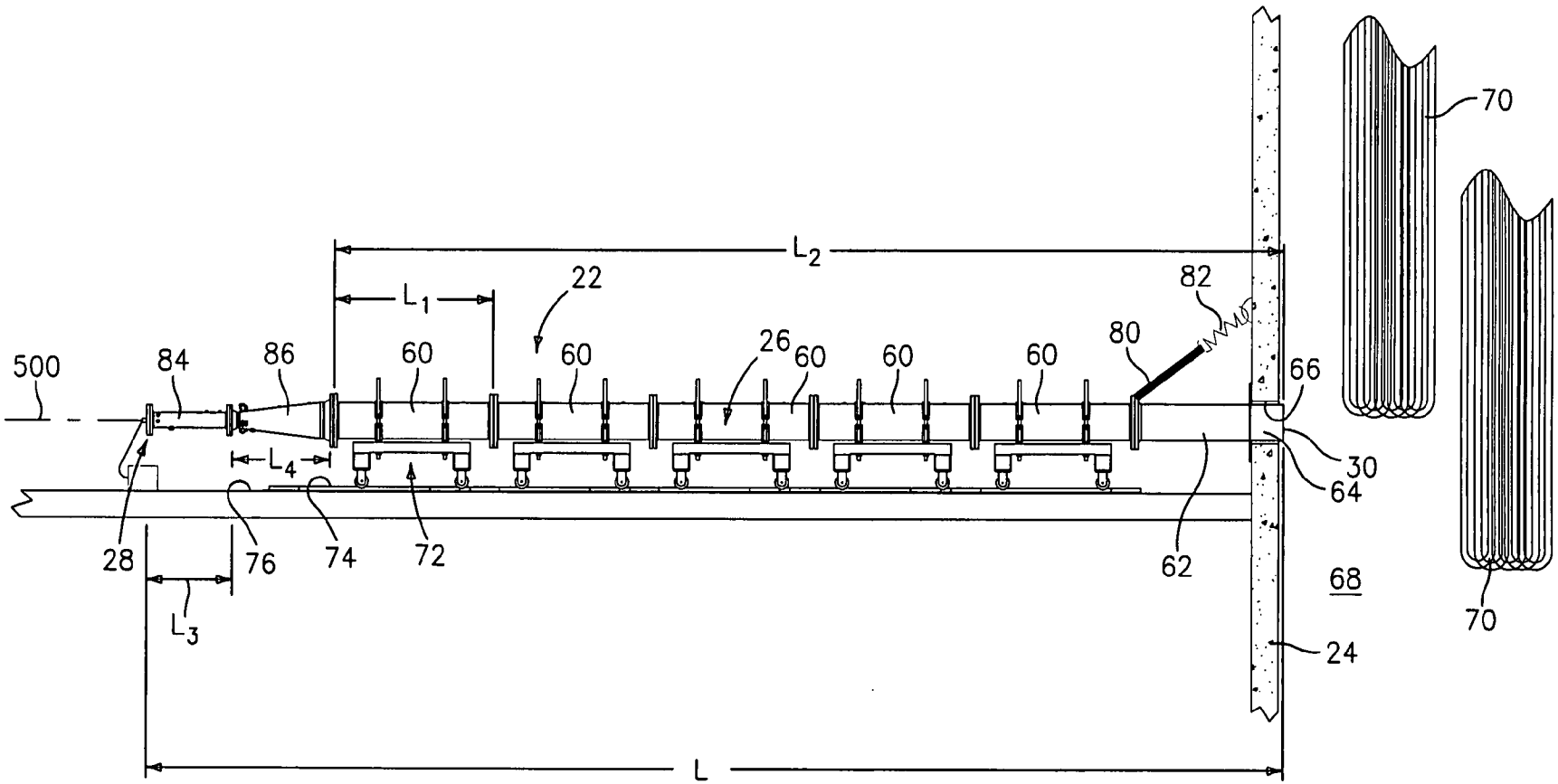
FIG. 2 is a side view of one of the blowers of FIG. 1.

FIG. 2 shows further details of an exemplary soot blower 22. The exemplary detonation conduit 26 is formed with a main body portion formed by a series of doubly flanged conduit sections or segments 60 arrayed from upstream to downstream and a downstream nozzle conduit section or segment 62 having a downstream portion 64 extending through an aperture 66 in the wall and ending in the downstream end or outlet 30 exposed to the furnace interior 68. The term nozzle is used broadly and does not require the presence of any aerodynamic contraction, expansion, or combination thereof. Exemplary conduit segment material is metallic (e.g., stainless steel). The outlet 30 may be located further within the furnace if appropriate support and cooling are provided. FIG. 2 further shows furnace interior tube bundles 70, the exterior surfaces of which are subject to fouling. In the exemplary embodiment, each of the conduit segments 60 is supported on an associated trolley 72, the wheels of which engage a track system 74 along the facility floor 76. The exemplary track system includes a pair of parallel rails engaging concave peripheral surfaces of the trolley wheels. The exemplary segments 60 are of similar length $L_1$ and are bolted end-to-end by associated arrays of bolts in the bolt holes of their respective flanges. Similarly, the downstream flange of the downstreammost of the segments 60 is bolted to the upstream flange of the nozzle 62. In the exemplary embodiment, a reaction strap 80 (e.g., cotton or thermally/structurally robust synthetic) in series with one or more metal coil reaction springs 82 is coupled to this last mated flange pair and connects the combustion conduit to an environmental structure such as the furnace wall for resiliently absorbing reaction forces associated with discharging of the soot blower and ensuring correct placement of the combustion conduit for subsequent firings. Optionally, additional damping (not shown) may be provided. The reaction strap/spring combination may be formed as a single length or a loop. In the exemplary embodiment, this combined downstream section has an overall length $L_2$. Alternative resilient recoil absorbing means may include non-metal or non-coil springs or rubber or other elastomeric elements advantageously at least partially elastically deformed in tension, compression, and/or shear, pneumatic recoil absorbers, and the like.

Extending downstream from the upstream end 28 is a predetonator conduit section/segment 84 which also may be doubly flanged and has a length $L_3$. The predetonator conduit segment 84 has a characteristic internal cross-sectional area (transverse to an axis/centerline 500 of the conduit) which is smaller than a characteristic internal cross-sectional area (e.g., mean, median, mode, or the like) of the downstream portion (60, 62) of the combustion conduit. In an exemplary embodiment involving circular sectioned conduit segments, the predetonator cross-sectional area is a characterized by a diameter of between 8 cm and 12 cm whereas the downstream portion is characterized by a diameter of between 20 cm and 40 cm. Accordingly, exemplary cross-sectional area ratios of the downstream portion to the predetonator segment are between 1:1 and 10:1, more narrowly, 2:1 and 10:1. An overall length L between ends 28 and 30 may be 1-15 m, more narrowly, 5-15 m. In the exemplary embodiment, a transition conduit segment 86 extends between the predetonator segment 84 and the upstreammost segment 60. The segment 86 has upstream and downstream flanges sized to mate with the respective flanges of the segments 84 and 60 has an interior surface which provides a smooth transition between the internal cross-sections thereof. The exemplary segment 86 has a length $L_4$. An exemplary half angle of divergence of the interior surface of segment 86 is $\leqq 12°$, more narrowly 5-10°.

Figure 3:
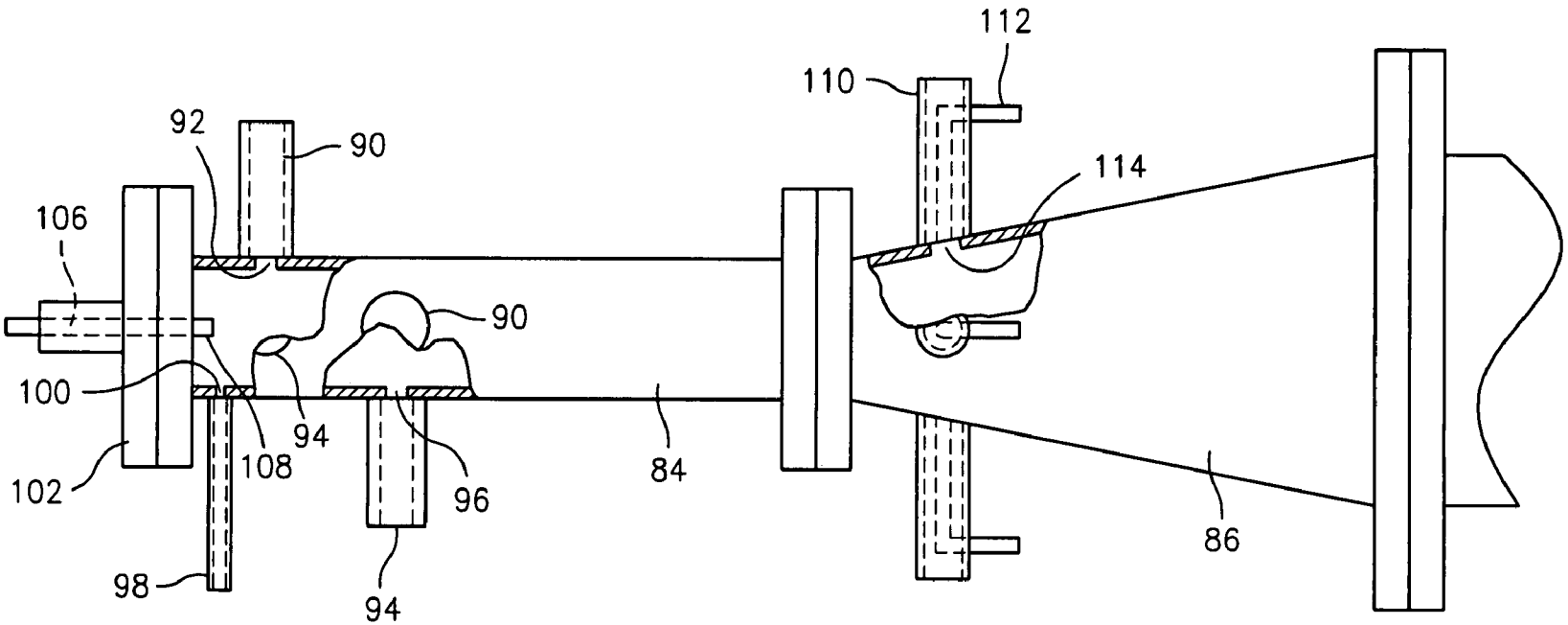
FIG. 3 is a partially cut-away side view of an upstream end of the blower of FIG. 2.

A fuel/oxidizer charge may be introduced to the detonation conduit interior in a variety of ways. There may be one or more distinct fuel/oxidizer mixtures. Such mixture(s) may be premixed external to the detonation conduit, or may be mixed at or subsequent to introduction to the conduit. FIG. 3 shows the segments 84 and 86 configured for distinct introduction of two distinct fuel/oxidizer combinations: a predetonator combination; and a main combination. In the exemplary embodiment, in an upstream portion of the segment 84, a pair of predetonator fuel injection conduits 90 are coupled to ports 92 in the segment wall which define fuel injection ports. Similarly, a pair of predetonator oxidizer conduits 94 are coupled to oxidizer inlet ports 96. In the exemplary embodiment, these ports are in the upstream half of the length of the segment 84. In the exemplary embodiment, each of the fuel injection ports 92 is paired with an associated one of the oxidizer ports 96 at even axial position and at an angle (exemplary 90° shown, although other angles including 180° are possible) to provide opposed jet mixing of fuel and oxidizer. Discussed further below, a purge gas conduit 98 is similarly connected to a purge gas port 100 yet further upstream. An end plate 102 bolted to the upstream flange of the segment 84 seals the upstream end of the combustion conduit and passes through an igniter/initiator 106 (e.g., a spark plug) having an operative end 108 in the interior of the segment 84.

In the exemplary embodiment, the main fuel and oxidizer are introduced to the segment 86. In the illustrated embodiment, main fuel is carried by a number of main fuel conduits 112 and main oxidizer is carried by a number of main oxidizer conduits 110, each of which has terminal portions concentrically surrounding an associated one of the fuel conduits 112 so as to mix the main fuel and oxidizer at an associated inlet 114. In exemplary embodiments, the fuels are hydrocarbons. In particular exemplary embodiments, both fuels are the same, drawn from a single fuel source but mixed with distinct oxidizers: essentially pure oxygen for the predetonator mixture; and air for the main mixture. Exemplary fuels useful in such a situation are propane, MAPP gas, or mixtures thereof. Other fuels are possible, including ethylene and liquid fuels (e.g., diesel, kerosene, and jet aviation fuels). The oxidizers can include mixtures such as air/oxygen mixtures of appropriate ratios to achieve desired main and/or predetonator charge chemistries. Further, monopropellant fuels having molecularly combined fuel and oxidizer components may be options.

In operation, at the beginning of a use cycle, the combustion conduit is initially empty except for the presence of air (or other purge gas). The predetonator fuel and oxidizer are then introduced through the associated ports filling the segment 84 and extending partially into the segment 86 (e.g., to near the midpoint) and advantageously just beyond the main fuel/oxidizer ports. The predetonator fuel and oxidizer flows are then shut off. An exemplary volume filled the predetonator fuel and oxidizer is 1-40%, more narrowly 1-20%, of the combustion conduit volume. The main fuel and oxidizer are then introduced, to substantially fill some fraction (e.g., 20-100%) of the remaining volume of the combustor conduit. The main fuel and oxidizer flows are then shut off. The prior introduction of predetonator fuel and oxidizer past the main fuel/oxidizer ports largely eliminates the risk of the formation of an air or other non-combustible slug between the predetonator and main charges. Such a slug could prevent migration of the combustion front between the two charges.

With the charges introduced, the spark box is triggered to provide a spark discharge of the initiator igniting the predetonator charge. The predetonator charge being selected for very fast combustion chemistry, the initial deflagration quickly transitions to a detonation within the segment 84 and producing a detonation wave. Once such a detonation wave occurs, it is effective to pass through the main charge which might, otherwise, have sufficiently slow chemistry to not detonate within the conduit of its own accord. The wave passes longitudinally downstream and emerges from the downstream end 30 as a shock wave within the furnace interior, impinging upon the surfaces to be cleaned and thermally and mechanically shocking to typically at least loosen the contamination. The wave will be followed by the expulsion of pressurized combustion products from the detonation conduit, the expelled products emerging as a jet from the downstream end 30 and further completing the cleaning process (e.g., removing the loosened material). After or overlapping such venting of combustion products, a purge gas (e.g., air from the same source providing the main oxidizer and/or nitrogen) is introduced through the purge port 100 to drive the final combustion products out and leave the detonation conduit filled with purge gas ready to repeat the cycle (either immediately or at a subsequent regular interval or at a subsequent irregular interval (which may be manually or automatically determined by the control and monitoring system)). Optionally, a baseline flow of the purge gas may be maintained between charge/discharge cycles so as to prevent gas and particulate from the furnace interior from infiltrating upstream and to assist in cooling of the detonation conduit.

Figure 4:
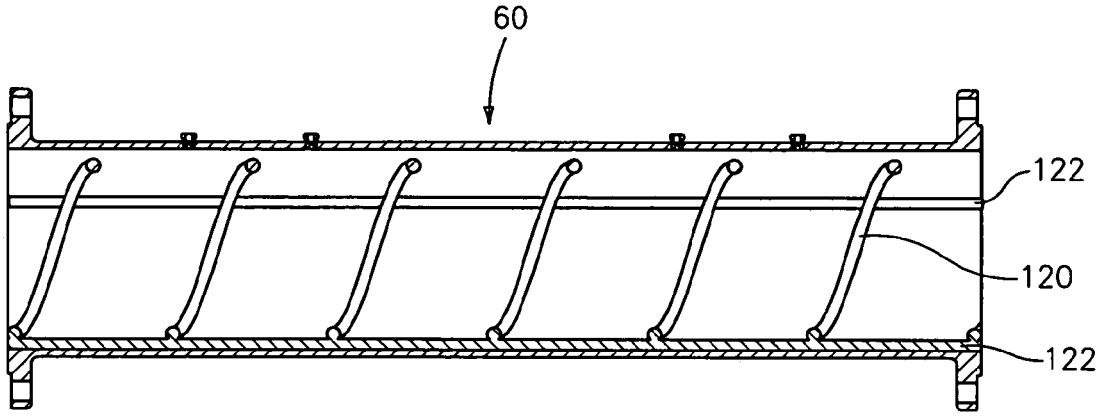
FIG. 4 is a longitudinal sectional view of a main combustor segment of the soot blower of FIG. 2.
Figure 5:
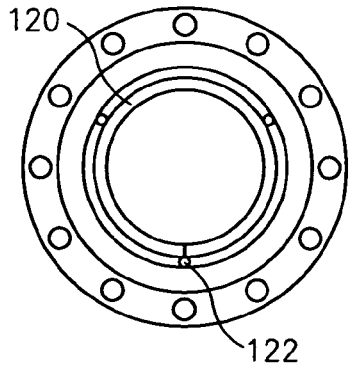
FIG. 5 is an end view of the segment of FIG. 4.

In various implementations, internal surface enhancements may substantially increase internal surface area beyond that provided by the nominally cylindrical and frustoconical segment interior surfaces. The enhancement may be effective to assist in the deflagration-to-detonation transition or in the maintenance of the detonation wave. FIG. 4 shows internal surface enhancements applied to the interior of one of the main segments 60. The exemplary enhancement is nominally a Chin spiral, although other enhancements such as Shchelkin spirals and Smirnov cavities may be utilized. The spiral is formed by a helical member 120. The exemplary member 120 is formed as a circular-sectioned metallic element (e.g., stainless steel wire) of approximately 8-20 mm in sectional diameter. Other sections may alternatively be used. The exemplary member 120 is held spaced-apart from the segment interior surface by a plurality of longitudinal elements 122. The exemplary longitudinal elements are rods of similar section and material to the member 120 and welded thereto and to the interior surface of the associated segment 60. Such enhancements may also be utilized to provide predetonation in lieu of or in addition to the foregoing techniques involving different charges and different combustor cross-sections.

The apparatus may be used in a wide variety of applications. By way of example, just within a typical coal-fired furnace, the apparatus may be applied to: the pendants or secondary superheaters, the convective pass (primary superheaters and the economizer bundles); air preheaters; selective catalyst removers (SCR) scrubbers; the baghouse or electrostatic precipitator; economizer hoppers; ash or other heat/accumulations whether on heat transfer surfaces or elsewhere, and the like. Similar possibilities exist within other applications including oil-fired furnaces, black liquor recovery boilers, biomass boilers, waste reclamation burners (trash burners), and the like.

Figure 6:
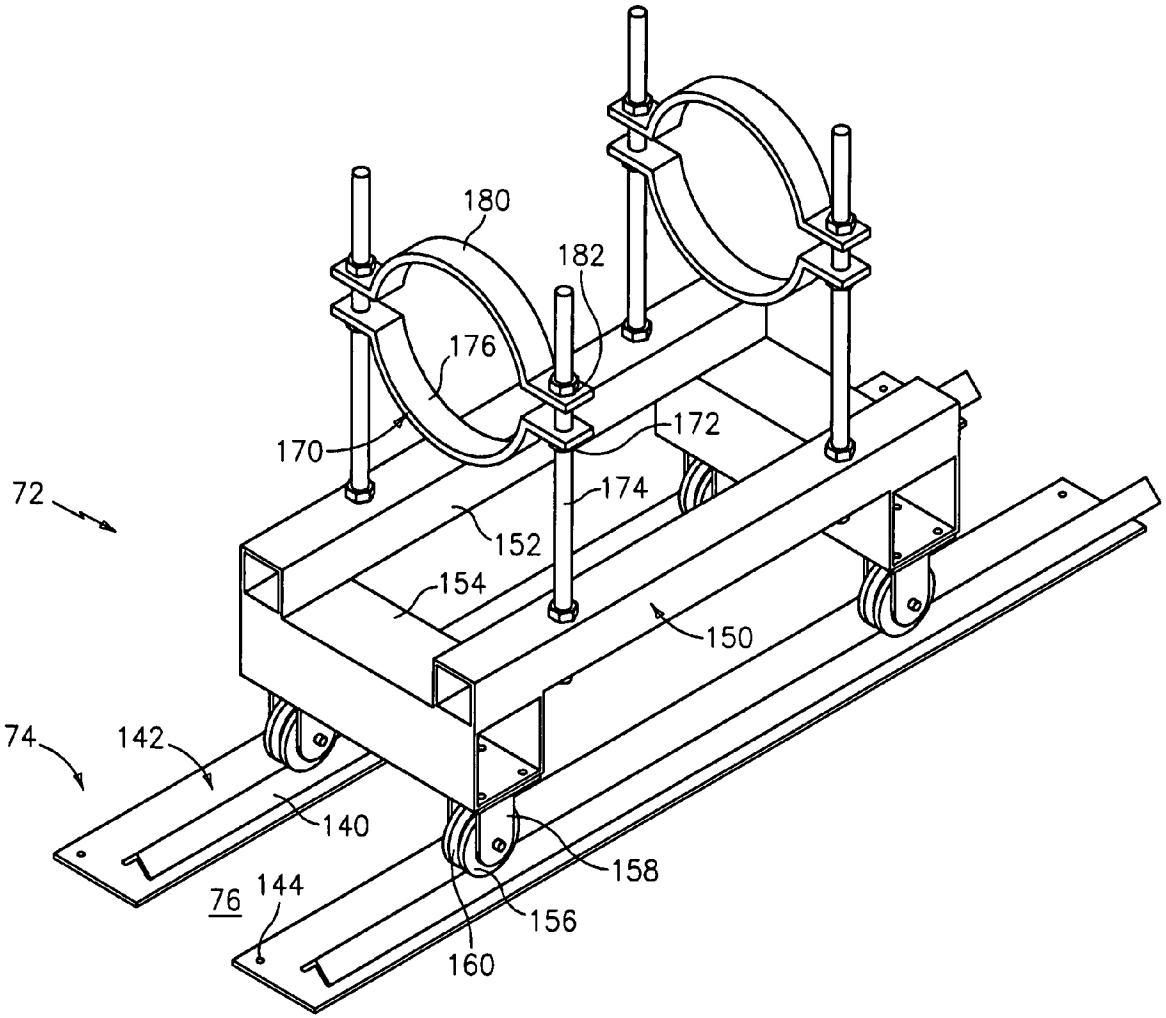
FIG. 6 is a view of a conduit segment support trolley of the system of FIG. 1.

FIG. 6 shows further details of the exemplary trolley 72 and track system 74. The exemplary track system comprises a pair of parallel vertex-up right angle channel elements 140 (e.g., of steel) secured such as by welding to mounting plates 142. The mounting plates are, in turn, secured to the floor 76 such as via bolts (not shown) in bolt holes 144. The exemplary trolley includes a structural frame 150 having a pair of left and right longitudinal members 152 and fore and aft crossmembers 154. At the left and right sides of each crossmember, a wheel 156 is mounted on a depending bracket 158. The wheel periphery has a concavity (e.g., a right-angle V-groove 160) receiving the vertex of the right angle channel elements 140. The exemplary trolley has means for supporting the associated conduit segment and means for securing the segment in place. The exemplary support means include a pair of fore and aft tube/pipe clamps 170 each positioned and supported by nuts 172 on associated left and right threaded shafts 174 secured at their lower ends to the frame. The clamps 170 have a concave surface 176 complementary to the exterior body surface of the associated conduit segment to support the segment from below. The securing means comprises similar top brackets 180 also mounted to the shafts 174 and held downward in place in compressive engagement with the segment via nuts 182.

A number of options are available for using the trolleys. The individual segments may be preassembled to their associated trolleys and rolled into place along the track system, whereupon the segments may be secured to each other via their end flanges. Disassembly may be by a reverse of this process. The trolleys may also allow the combustion conduit to be moved as a unit (e.g., if it is desired that the downstream portion of the conduit not be inserted into the furnace all the time). Additionally, as noted above, the trolleys may accommodate movement as a unit associated with longitudinal thermal expansion and/or with recoil during discharge cycles while maintaining conduit segment alignment.

Figure 7:
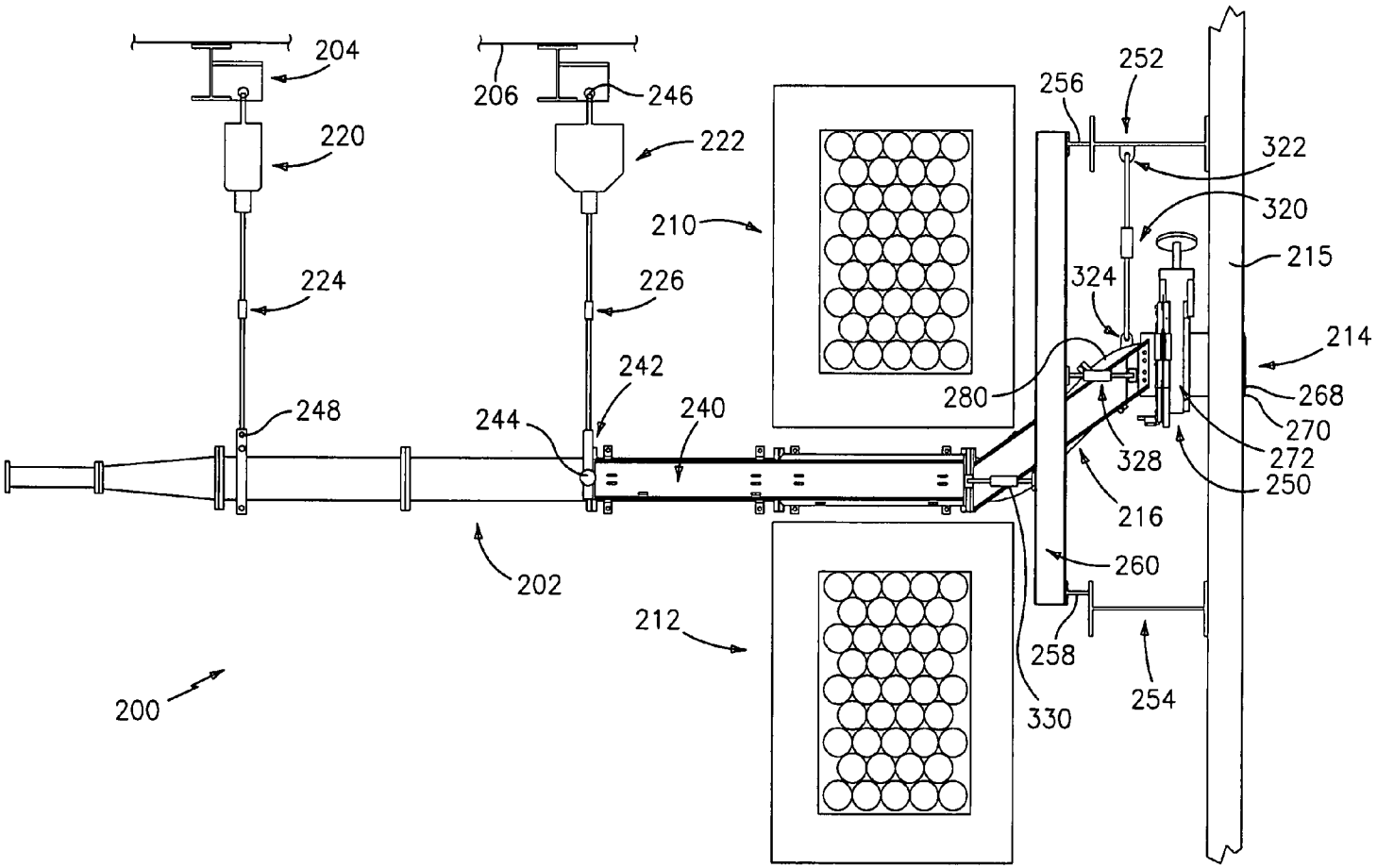
FIG. 7 is a side view of an alternate combustion conduit.

FIG. 7 shows an alternate system 200 wherein the combustion conduit 202 is suspended from brackets 204 (e.g., as part of a free-standing support structure or secured to a ceiling or roof 206 of the facility). Such a system may be particularly useful where the conduit is positioned high above a facility floor. The exemplary system 200 navigates the conduit 202 around environmental obstacles external to the furnace. Exemplary obstacles include upper and lower tube bundles 210 and 212 between which the conduit passes. In the exemplary embodiment, the conduit is circuitous to permit positioning of its outlet 214 in a position on the furnace wall aligned with one of the two bundles. In such a situation, a straight conduit would be interfered with by the bundles. Accordingly, the conduit is provided with one or more curved sections 216 to accommodate the bundles.

From upstream to downstream, the exemplary support system includes an upstream and an intermediate spring hanger 220 and 222 coupled to associated conduit segments by turnbuckle systems 224 and 226. Exemplary spring hangers are available from LISEGA, Inc., Newport, Tenn. In the exemplary embodiment, the spring hanger 222 may have substantially higher capacity due to a higher static load at that location. The particular combination of hanger sizings may be influenced by the relative locations of the hangers along the conduit in view of mass parameters of the conduit (e.g., center of gravity, mass distribution, and the like), strength parameters of the conduit (e.g., various modulus), and the location of any additional support. The exemplary spring hangers serve as essentially constant-load hangers, with supportive tensile force essentially constant over an operating range. One function of the vertical compliance afforded by the hangers is to accommodate thermally-associated changes in the vertical position of the outlet 214 relative to the ceiling surface 206 or other combustion conduit support structure. For example, thermal expansion of the furnace wall may cause a change in outlet vertical position between hot and cold (e.g., running and off) furnace conditions. In the embodiment of FIG. 2, such expansion is addressed by non rigid vertical coupling of the conduit and wall with sufficient vertical play for the conduit within the oversized wall aperture. With rigid mounting, however, if furnace heating raises the conduit outlet height, in the absence of the constant force hangers, a greater fraction of the conduit mass would be carried by the furnace wall and a lesser fraction by the upstream supports. This would be associated with shear/bending forces/moments and associated deformations. The spring hangers, however, will tend to contract, raising the segment(s) to which they are attached to so that the mass supported by the furnace wall does not substantially increase and thus to at least partially, and advantageously in major part, relieve/prevent stresses that otherwise would be associated with the outlet elevation increase the hangers may, therefore maintain an essentially constant orientation of the conduit (e.g., maintaining its upstream major portion in an essentially horizontal orientation).

In the exemplary embodiment, a support structure 240 external to the combustion conduit further reinforces the associated assembled segments. Such reinforcement advantageously handles structural stresses associated with shock reflections occurring within the curved segments. In the illustrated embodiment, the structure further rigidly ties downstream portions of the conduit to the furnace wall. In the exemplary embodiment, the turnbuckle 226 is connected via its lower threaded rod to a fixture 242 secured to the upstream end of the support structure and having snubbers 244 to accommodate and dampen side-to-side motion of the conduit which may arise from the combustion process. The snubbers thus provide lateral stability and ensure the conduit remains aligned with the furnace aperture (without excess transverse bending of the conduit). In the exemplary embodiment, the rigid connection of the support structure to the furnace wall or to other environmental structure absorbs the recoil forces, essentially preventing recoil. To the extent that longitudinal thermal expansion of the conduit remains an issue, such expansion may be taken up by allowing the hangers to pivot (e.g., relative to connection locations 246 to the brackets 204 above and the connection point 248 with the associated conduit engagement fixture below. Alternative embodiments may remove the rigid coupling of the conduit to the wall and permit a resilient or damped coupling.

The support structure 240 is directly mated to several of the doubly flanged conduit segments and connects such segments to the wall 215 via a discharge valve assembly 250 and exemplary preexisting horizontal structural furnace I-beams 252 and 254 above and below the valve assembly 250. In the exemplary implementation, extension beams 256 and 258 are welded to outboard flanges of the respective beams 252 and 254. Exemplary beams 256 and 258 are T-beams, although I-beams may also be used. In the exemplary embodiment, there are pairs of left and right beams 256 and left and right beams 258 with respective pairs spanned by left and right vertically-extending I-beams 260 each having an inboard flange secured to the head flange of the associated beams 256 and 258.

Figure 8:
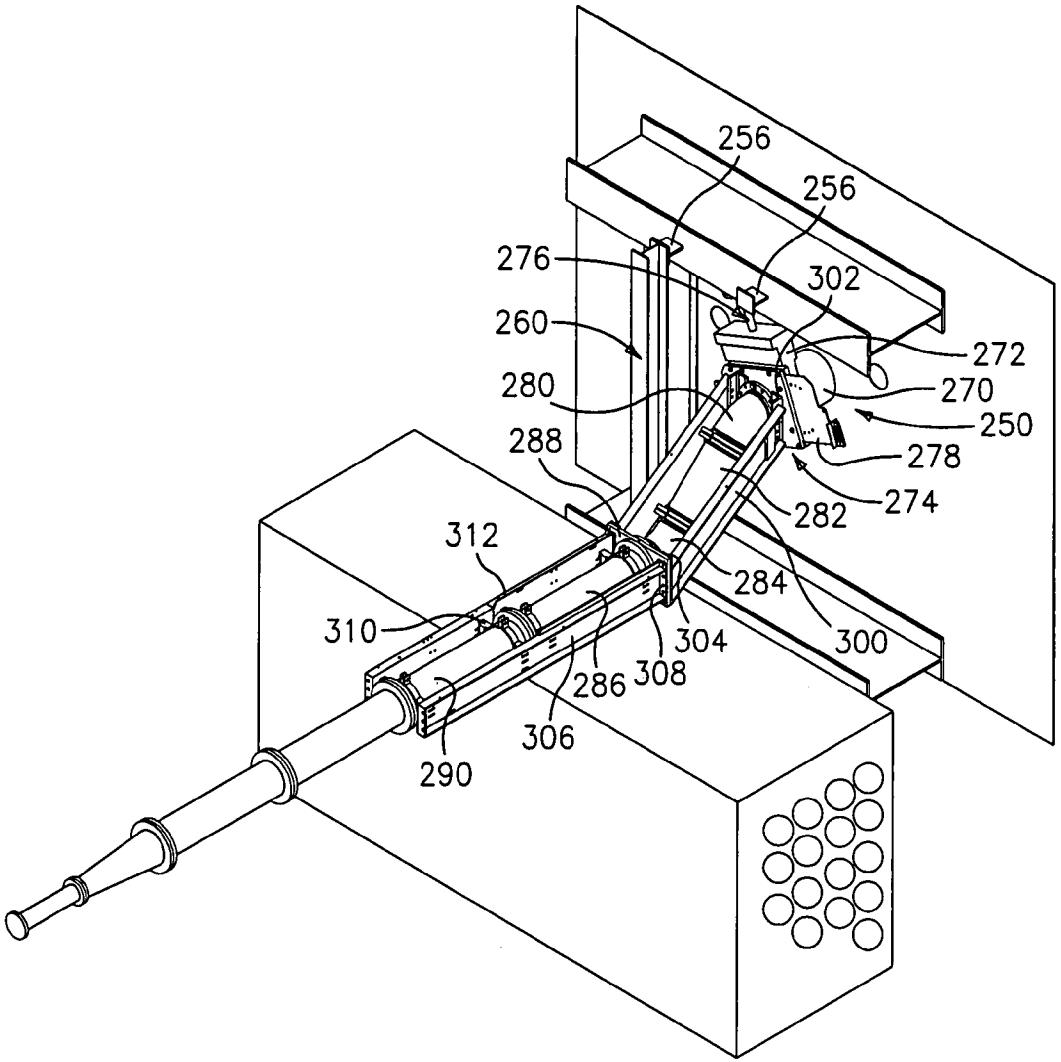
FIG. 8 is a view of the alternate combustion conduit with an upper external tube pack and various support features removed to show detail.

Downstream, the combustion conduit includes a nozzle portion 268 extending through an access conduit 270 and access valve 272 of the assembly 250. The access conduit 270, the access valve 272, and wall mounting plate (not shown) provide an access assembly. The access valve 272 has a body with a downstream face mounted to an upstream flange of the conduit 270. The nozzle 268 is secured to and extends downstream from the body of a second valve or conduit valve 274 (FIG. 8). That body has a downstream face mounted to the upstream face of the body of the access valve 272. The valves 272 and 274 have respective slider or gate elements 276 and 278 which may be translated between open and closed positions. Continuing upstream, a downstream 45° curved elbow 280 has a downstream flange mounted to the upstream face of the body of the conduit valve 274 and an upstream flange mounted to a downstream flange of a straight conduit segment 282. The upstream flange of the segment 282 is mounted to the downstream flange of a second 45° elbow 284. The upstream flange of the elbow 284 is secured to the downstream flange of a downstreammost segment 286 of a major upstream straight portion of the combustion conduit. The exemplary mounting sandwiches a brace interface plate 288 between these two flanges. The upstream flange of the segment 286 is mounted to the downstream flange of a penultimate segment 290 of the straight portion with further segments similarly mounted in series thereahead.

The exemplary support structure 240 includes a pair of left and right diagonally-extending downstream braces 300 having downstream ends connected by mounting brackets 302 to the upstream face of the body of the valve 274 and downstream ends connected by mounting brackets 304 to the downstream face of the plate 288. Positioned end-to-end with the braces 300 are left and right longitudinal braces 306 having downstream ends connected via brackets 308 to the upstream face of the plate 288. The exemplary braces are U-sectioned with inboard vertical webs and transverse flanges. Just inboard of upstream and downstream flanges of the segments 286 and 290, the braces 306 are secured to each other by split clamps 310 which compressively engage the adjacent conduit segment bodies. In the exemplary embodiment, an additional structural rib 312 is welded to each brace 306 along the downstream half thereof, aligned with and extending upward from the web thereof above the upper flange thereof.

The braces help rigidify and strengthen the assembled segments 280, 282, 284, 286, and 290. These braced segments may be vertically supported and restrained against horizontal movement. In the illustrated embodiment, the hanger 222 (FIG. 7) is just upstream of the upstream end of the braces 306. An additional hanger is provided by a downstream turnbuckle 320 near the downstream end of the braces 300. In the exemplary embodiment, the turnbuckle 320 has an upper threaded rod connected to a pivot 322 welded to the underside of the flange of the beam 252 and a lower threaded rod connected to a pivot 324 on a clamp on the body of the segment 280 near the downstream end thereof. On each of the left and right sides of the conduit, first and second horizontal tumbuckles 328 and 330 essentially respectively restrain the braced segments against downstream and upstream movement. In the exemplary embodiment, the first tumbuckles 328 span between a downstream end portion of the associated brace 300 and the vertical beam 260 upstream thereof and the second turnbuckles 330 span between the plate 288 and the beam 260 downstream thereof. In the exemplary embodiment, the assembly 250 is rigidly positioned relative to the wall 215. In such a situation, little compliance is needed near the downstream end of the conduit and thus the exemplary turnbuckle 320 is not associated with a spring hanger. Similarly, a lack of compliance is associated with the tumbuckles 328 and 330. In alternate embodiments, however, the discharge/outlet end of the conduit may not be rigidly positioned (e.g., may have a degree of float relative to an aperture in the wall). In such a situation, more compliant vertical and horizontal mounting may be provided, the latter optionally including resilient recoil absorbing means.

In an exemplary installation sequence, the second valve is installed to the access valve as is described in copending application docket EH-10965 (03-435), filed on even date herewith, the disclosure of which is incorporated by reference in its entirety herein as if set forth at length. The downstream elbow 280 may then be secured to the upstream face of the body of the conduit valve 274. The turnbuckle 320 may be installed. The straight segment 282 may be installed to the downstream elbow 280 and the upstream elbow 284 installed to the straight segment 282. The interface plate 288 may be installed to the upstream flange of the elbow 284. The mounting brackets 302 and 304 and associated downstream braces 300 may then be installed followed by the tumbuckles 328 and 330. The downstreammost two segments 286 and 290 of the main straight conduit section may sequentially be assembled and the associated clamps 310 installed thereto. The braces 306 may be installed to the clamps and to the brackets 308, in turn, installed to the interface plate 288. Alternatively, these segments, clamps, braces and brackets may be assembled as a unit and then installed as a unit to the adapter plate 288 and elbow 284. The downstream hanger assembly 222 may be installed along with the fixture 242 and snubbers 244. The remaining upstream full diameter conduit segments may be installed along with the upstream hanger assembly 220. The predetonator and transition conduits may then be installed followed by gas lines, controls, instrumentation, and the like.

One or more embodiments of the present invention have been described. Nevertheless, it will be understood that various modifications may be made without departing from the spirit and scope of the invention. For example, the invention may be adapted for use with a variety of industrial equipment and with variety of soot blower technologies. Aspects of the existing equipment and technologies may influence aspects of any particular implementation. Accordingly, other embodiments are within the scope of the following claims.

What is claimed is:

1. An apparatus for cleaning a surface within a vessel, the apparatus comprising:

an elongate combustion conduit extending from an upstream end to a downstream end associated with an aperture in a wall of the vessel and positioned to direct a shock wave toward said surface; and means for movably supporting the combustion conduit at one or more locations along a length of the combustion conduit, the means comurising one or more hangers wherein:

the one or more hangers engage first portions of the combustion conduit;

the one or more hangers couple the conduit to a support structure, the structure being separate from the furnace wall, and a second portion of the combustion conduit downstream of the first is held relative to the vessel so as to vertically move with the vessel due to thermal expansion of the vessel, the one or more hangers compliantly accommodating such vertical movement relative to said support structure.

2. The apparatus of claim 1 in combination with the vessel and wherein:

the vessel has a first external tube bundle and a second external tube bundle; and the combustion conduit passes above the first external tube bundle and below the second external tube bundle.

3. The apparatus of claim 1 wherein:

the combustion conduit comprises at least one curved portion.

4. The apparatus of claim 1 wherein:

the one or more hangers comprises one or more spring hangers.

5. The apparatus of claim 4 wherein:

at least one of the spring hangers engages the conduit via one or more snubbers.

6. The apparatus of claim 1 wherein:

a nozzle portion of the combustion conduit is parallel to but offset from a second portion of the combustion conduit.

7. The apparatus of claim 6 wherein:

said second portion forms a majority of a length of the combustion conduit.

8. The apparatus of claim 1 wherein:

the combustion conduit comprises a plurality of segments assembled end-to-end.

9. The apparatus of claim 8 further comprising:

external braces spanning a length of at least one of the segments.

10. The apparatus of claim 9 wherein:

there are at least first and second such external braces opposite each other and coupled to each other by at least one clamp grasping a body of an associated one of the segments.

11. The apparatus of claim 10 wherein:

there are third and fourth such braces respectively aligned end-to-end with the first and second external braces and secured thereto and extending relative thereto at a non-right and nonzero angle.

12. The apparatus of claim 8 wherein:

there is a support stnxcture integral with the wall; and the means includes at least one said hanger supporting the combustion conduit from the support structure.

13. An apparatus for cleaning a surface within a vessel, the apparatus comprising:

an elongate combustion conduit extending from an upstream end to a downstream end associated with an aperture in a wall of the vessel and positioned to direct a shock wave toward said surface; and one or more hangers supporting the combustion conduit at one or more locations along a length of the combustion conduit, wherein:

the one or more hangers engage first portions of the combustion conduit; the one or more hangers couple the conduit to a support structure, the structure being separate from the furnace wall, and a second portion of the combustion conduit downstream of the first is held relative to the vessel so as to vertically move with the vessel due to thermal exnansion of the vessel, the one or more hangers compliantly accommodating such vertical movement relative to said support structure.

14. The apparatus of claim 13 wherein:

the combustion conduit comprises at least one curved portion.

15. The apparatus of claim 13 wherein:

the hangers are constant load hangers.

16. The apparatus of claim 13 wherein:

the one or more hangers comprises a plurality of spring hangers.

17. The apparatus of claim 16 wherein:

at least one of the spring hangers engages the conduit via one or more snubbers.

18. A combination of a vessel and an apparatus for cleaning a surface within the vessel, wherein:

the vessel has a first external tube bundle and a second external tube bundle; and the apparatus comprises:

an elongate combustion conduit extending from an upstream end to a downstream end associated with an aperture in a wall of the vessel and positioned to direct a shock wave toward said surface, the combustion conduit passing above the first external tube bundle and below the second external tube bundle; and means for movably suspending the combustion conduit at one or more locations along a length of the combustion conduit.

19. The apparatus of claim 18 in combination with the vessel and wherein:

the means comprises one or more hangers wherein:

the hangers engage first portions of the combustion conduit; and a second portion of the combustion conduit downstream of the first is held relative to the vessel so as to vertically move with the vessel due to thermal expansion of the vessel, the hangers compliantly accommodating such vertical movement.

* * * * *